United States Patent [19]

Wulf et al.

[11] Patent Number: 5,020,822

[45] Date of Patent: Jun. 4, 1991

[54] SKI BOOT AND SKI BOOT-BINDING

[76] Inventors: Elmer B. Wulf, 1907 Jasmine, Denton, Tex. 76205; Mark E. Wulf, 24447 Boulevard DeJohn, Naperville, Ill. 60564

[21] Appl. No.: 433,850

[22] Filed: Nov. 8, 1989

Related U.S. Application Data

[63] Continuation-in-part of Ser. No. 224,887, Jul. 27, 1988, Pat. No. 4,880,251.

[51] Int. Cl.[5] ..... A63C 9/08

[52] U.S. Cl. ..... 280/613; 36/117; 280/634

[58] Field of Search ..... 280/613, 611, 612, 618, 280/634, 636, 809; 36/117, 121, 120

[56] References Cited

U.S. PATENT DOCUMENTS

| | | | |
|---|---|---|---|
| 3,931,982 | 1/1976 | Kubelka | 280/11.36 |
| 4,262,925 | 4/1981 | Plenk | 280/636 |
| 4,640,026 | 2/1987 | Kirsch | 280/613 |
| 4,653,203 | 3/1987 | De Mattheis | 280/613 |
| 4,658,517 | 4/1987 | Miyoshi | 36/117 |
| 4,712,315 | 12/1987 | Morell | 36/117 |
| 4,837,494 | 6/1989 | Maier | 280/809 |
| 4,880,251 | 11/1989 | Wulf et al. | 280/613 |
| 4,905,385 | 3/1990 | Perrissoud | 36/121 |

*Primary Examiner*—David M. Mitchell
*Attorney, Agent, or Firm*—Lee, Mann, Smith, McWilliams & Sweeney

[57] ABSTRACT

A ski boot and a ski boot incorporating a releasable ski binding which attaches the boot to a ski. The boot-binding includes a first connecting portion secured to the ski, a second connecting portion secured to the boot, a plunger combination for releasably coupling the first and second connecting portions so that the boot may release in any direction, and an actuation device engaging the plunger combination for maintaining coupling of the first and second coupling portions. The actuation device has a pivotal lever arm mounted for withdrawing one of the plungers and an arm stay secured to the ski boot for releasably retaining the pivotal lever arm. The ski boot includes a living hinge in the sole to facilitate walking in the boot, and the hinge may be locked to inhibit the hinging function. The boot extends well above the ankle and is stiffened on the inside or outside to securely mount the arm stay. For retaining a foot in place, the boot includes a foot-enveloping foot positioning device which surrounds the arch and instep of a foot inside the ski boot when the boot is worn. The foot positioning device is adjustable to both fit the foot and also hold the foot at the heel of the boot.

34 Claims, 10 Drawing Sheets

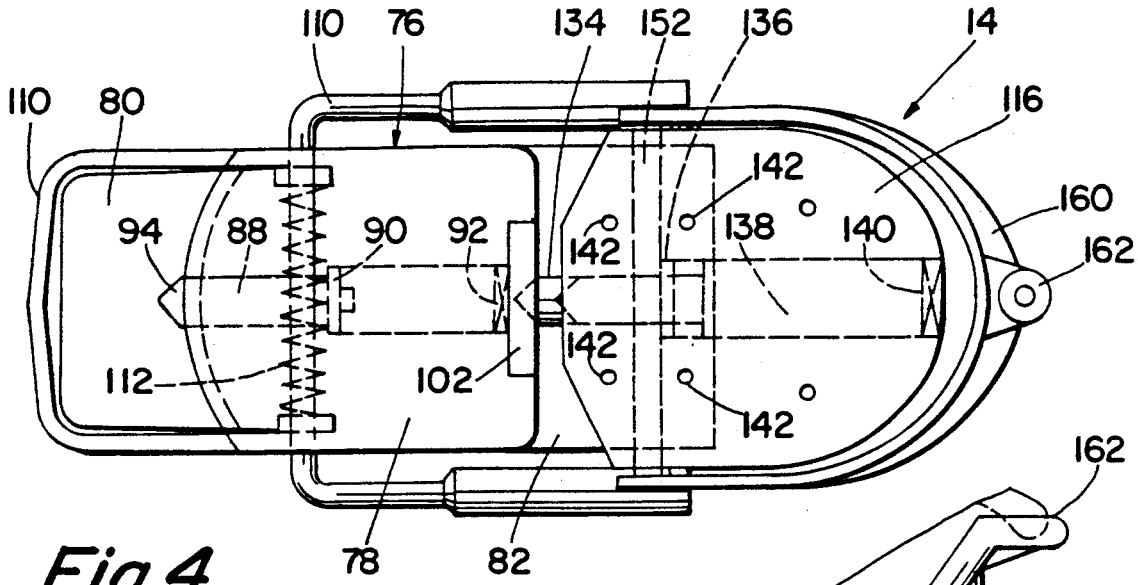
Fig. 4
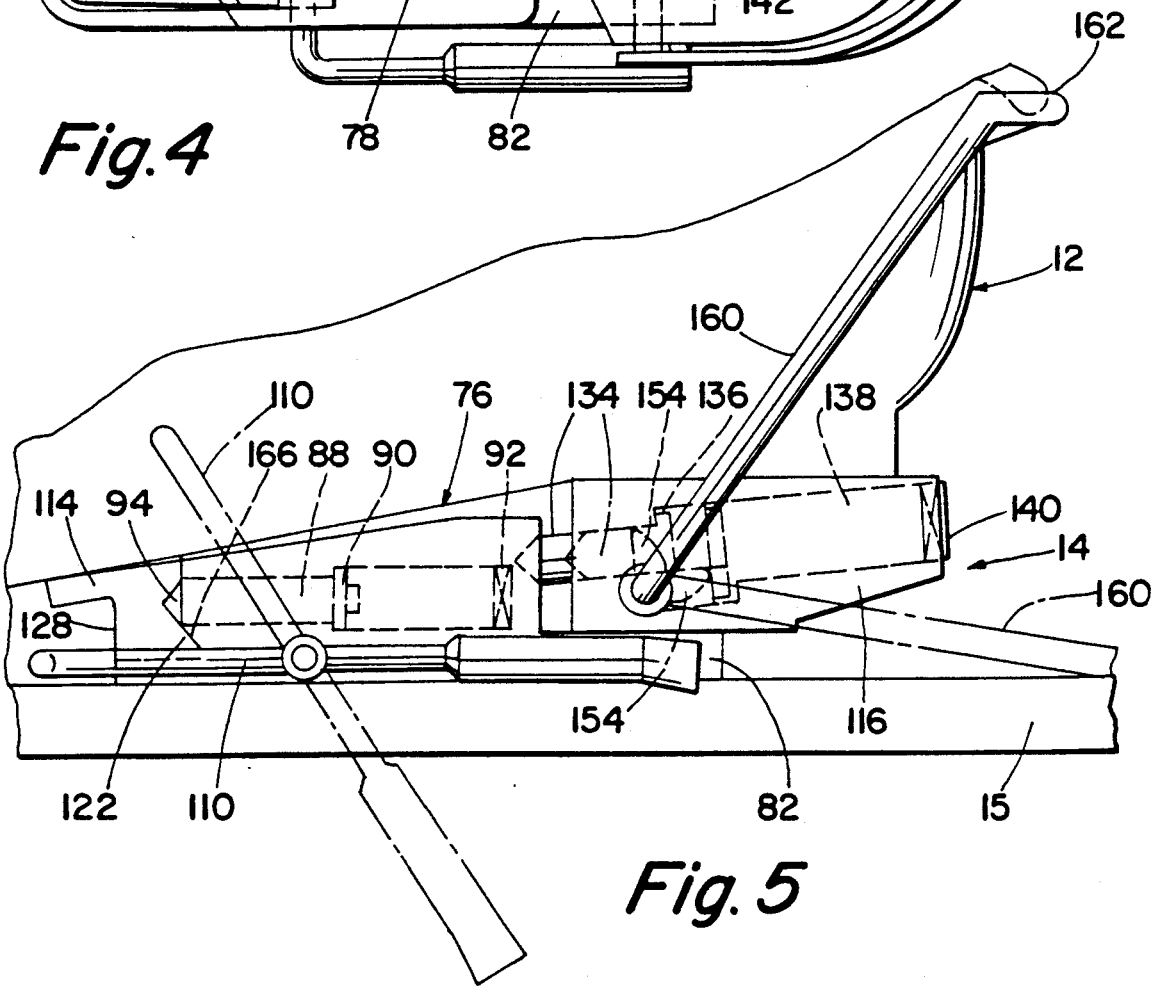
Fig. 5
Fig. 6
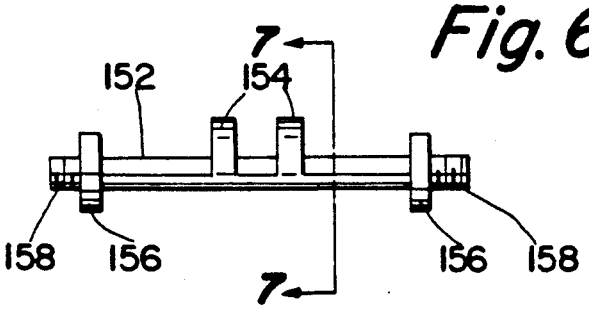
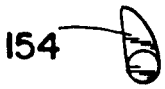
Fig. 7

6°
136
134
102
60°-90°

102
60°-90°
108
134
136

78
15
108
102
104
106

104
106
108
102

124
122
120
122
124
118

90
88
94
70°-90°

96
98

124
118
122
120
122
124
126
114
132
128
126

118
122
30°-45°
126
128
126

96
98

100
98
96
166
30°-45°

SKI BOOT AND SKI BOOT-BINDING

RELATED APPLICATION

This application is a continuation-in-part of U.S. patent application Ser. No. 224,887, filed July 27, 1988, now U.S. Pat. No. 4,880,251, issued Nov. 14, 1989.

BACKGROUND OF THE INVENTION

This invention relates to ski boots and ski bindings, and in particular to an operative combination of a ski boot and integral binding which is simple, effective and which allows release in all directions. This invention also relates to improvements in the structure of a ski boot, including the facilitation of walking in the boot, rearward release to prevent knee injuries, and adjustability of the degree of forward and rear lean of the skier's leg when the boot is worn.

As the technology relating to skis and ski boots advances, leg injuries encountered by skiers have been reduced dramatically. However, the vast majority of all commercial skiing combinations comprise a ski boot, a binding for attachment of the boot to a ski, and, of course, a ski. Typically, the manufacturers of the ski, binding and boot are different, leading to the possibility of incompatability, but, more importantly, preventing more radical advances in skiing safety by permitting integration of these three operative elements, or of at least the ski boot and bindings. Therefore, bindings, while experiencing minor advances over the years, have still clung to the decades old structure of a toe portion and a heel portion, which clamp respectively to the skier's boot toe and boot heel. Because the typical boot sole is quite long, clamping at these great lengths necessitates a rather long lever arm for release.

U.S. Pat. No. 3,918,732 describes a considerable improvement in ski bindings, where the degree of reliability of the release of the binding is increased greatly over conventional heel and toe bindings. However, the structure requires the skier to be somewhat elevated above the ski in relation to elevations with conventional heel and toe bindings, an additional height which may be objectionable to some skiers. Also, with one exception, the binding of this patent is a separate structure from the boot, necessitating an additional plate and therefore additional weight. Thus, while a considerable improvement over conventional heel and toe bindings, the invention of this patent is not the perfect answer to problems encountered with heel and toe bindings.

Conventional ski boots have a relatively stiff, long sole in order to function compatibly with conventional heel and toe bindings. As a result, walking in ski boots for any distance whatsoever is an arduous, uncomfortable and awkward procedure. Also, most conventional ski boots of the clam shell type (having forward and rear cuffs) have only limited lean adjustment in the forward direction and none rearward when the boot is closed for skiing. In this type of ski boot, and indeed, in most modern, stiff ski boots, ankle injuries have largely been eliminated, but, unfortunately, the stiffness of the boot and inability to bend rearwardly have created new knee problems, and in particular tears of the anterior cruciate ligaments. This type of injury can often end a skier's skiing career, or force the truly avid skier to wear a knee brace in order to be able to ski in the future.

The above-identified related patent, of which this application is a continuation-in-part, provides many operative improvements for both a ski boot and also the combination of a ski boot and releasable ski binding. The present invention provides additional improvements in both the boot and in the boot-binding combination, providing a truly operative and integrated structure having reliable release characteristics, injury protection, walking ease, and improved walking safety.

SUMMARY OF THE INVENTION

The invention pertains to a combined ski boot and binding for releasably attaching the ski boot to a ski, and also a novel ski boot. Included in the combination is a first connecting means secured to the ski beneath the boot and a second connecting means secured to the ski boot and spanning the first connecting means with portions of the second connecting means being in a fore-and-aft relationship generally along the length of the ski. Means is provided for releasably coupling the first and second connecting means so that the first and second connecting means may be separated in the forward, backward or lateral directions, or any combination thereof, under predetermined load conditions. The coupling means includes a first coupling element of the first connecting means engaged by a second coupling element of the second connecting means. Actuation means is provided for both urging the first and second coupling elements into engagement and also temporarily disengaging the first and second coupling elements. The actuation means includes a pivotal lever arm which is secured at one end to one of the first and second coupling elements, and an arm stay secured to the ski boot at the other end of the lever arm, the stay including means for releasably retaining the lever arm to permit the lever arm to pivot about the first end.

In accordance with the preferred form of the invention, the coupling means includes a major plunger and a minor plunger aligned with one another in the same direction and generally parallel to the longitudinal axis of the ski, the minor plunger being located in the first connecting means and the major plunger being located in the second connecting means and also comprising the second coupling element. First and second spaced and aligned sockets are provided for the plungers, each socket being engaged by one of the plungers. One of the sockets is located in the first connecting means and comprises the first coupling element, and the other socket is located in the second connecting means. In this form of the invention, the major plunger is located in the aft portion of the second connecting means. Also in this form of the invention, the major plunger is mounted to control separation in the forward and backward directions, and the minor plunger is mounted to control separation in the lateral direction.

The actuation means preferably includes first and second stops on the major plunger and a rotatable cam secured to a shaft, with the lever arm being secured to one end of the shaft. The cam is mounted between and bearing upon the two stops, which are mounted in a fore-and-aft relationship. The cam bears on the fore stop to urge the major plunger into engagement with its socket, and the cam bears on the aft stop to temporarily disengage the major plunger from its socket.

Means is provided for automatically engaging the lever arm with the arm stay in order to engage the major plunger and socket. That means comprises a spring in axial alignment with and bearing upon the plunger to urge the plunger in the fore direction. The spring does not contribute significantly to the force holding the major plunger in engagement with its socket, that force being provided by the lever arm bearing upon the first stop and the arm stay holding the lever arm in place.

The ski boot of the invention preferably includes a foot shell and an integral sole, with the arm stay being secured to the foot shell. The shell is stiffened between the sole and the stay in order to maintain the shell rigid in that location.

The ski boot includes hinged forward and rear cuffs which, when fastened to the leg of a skier, permit forward and rearward leg lean by the skier. That rearward and forward lean is controlled in one form of the invention by oppositely directed springs connected between the forward cuff and an immobile portion of the boot. In another form of the invention, for controlling forward lean, the boot is provided with an abutment in the foot shell and an aligned engagement member in the forward cuff. The engagement member is adjustable relative to the abutment to adjust the degree of forward lean. In this form of the invention, for controlling rearward lean, the invention includes a stop in the foot shell and an associated strap in the forward cuff which overlaps and engages the stop. The position of the strap is adjustable to vary the amount of rearward lean.

The ski boot includes release means secured to the rear cuff and engaging the lever arm for automatically disengaging the major plunger from its socket when the rear cuff opens to an open orientation. That release means comprises an elongate, flat strap having one end attached to the rear cuff and having a hook at its opposite end which engages the lever arm and pivots the lever arm when the rear cuff opens.

The lever arm may also be manually opened by pivoting the lever arm to disengage the major plunger from its socket. To accomplish manual opening, the invention includes a toggle member pivotable about a fixed point and having a cammed release surface engaging the lever arm.

In order to melt entrapped snow between the minor plunger and its socket, heating means is provided in the second connecting means. The heating means comprises a battery-operated heat probe connected to the socket engaged by the minor plunger.

The actuation means for the pivotal lever includes a pivotal latch having a sloped first retention surface with the lever arm including a complementary sloped second retention surface engaging the first retention surface of the latch. A spring loaded plunger engages the latch to hold the latch in place, and to allow its displacement. The actuation means also includes a first engaging surface and the lever arm includes a complementary sloped second engaging surface, the two engaging surfaces being sloped oppositely from the retention surfaces. The slopes of the engaging surfaces are less than the slopes of the retention surfaces to allow the lever arm to engage the arm stay with far less force than that necessary to disengage the lever arm from the arm stay.

In another form of the invention, the means for holding the latch comprises a solenoid-activated plunger engaging the latch. A force transducer is located on the latch and a microprocessor is provided, connected to the transducer in order to receive signals from the transducer. The microprocessor is also connected to the solenoid-activated plunger to activate the plunger dependent upon signals received from the transducer. Activation releases the lever arm, which, in turn, disconnects the major plunger from its socket, releasing the boot from the ski.

In this form of the invention, it is also preferred that the forces encountered by the minor plunger be electronically sensed. A force transducer is in contact with the minor plunger and is connected to the microprocessor which in turn is connected to the solenoid-activated plunger engaging the latch. The solenoid-activated plunger is activated dependent upon signals received from the transducer in order to disconnect the major plunger from its socket and permit lateral release.

The ski boot of the invention may be canted relative to the ski. For canting purposes, an angled cant is located between the sole of the ski boot and the second connecting means. Depending on the thickness of the angled cant, varying degrees of canting can be achieved.

The ski boot according to the invention also includes means for detaching the forward cuff from the rear cuff. The means for detaching ensures that under predetermined rearwardly-directed load conditions, the rear cuff will separate from the forward cuff to permit free movement of the rear cuff. In accordance with the preferred form of the invention, the cuffs are secured to one another by means of a strap attached to one of the cuffs and engaging a strap channel in the other cuff. An adjustable, spring-loaded plunger extends into the channel and engages a notch formed in the strap.

The foot shell of the ski boot comprises unattached first and second shell segments aligned in a front and rear orientation. One of the shell segments overlaps the other shell segment at approximately the location of the ball of a foot when within the boot, forming a living hinge in the sole in the vicinity of the overlap of the segments. Means is provided to lock the segments relative to one another to prevent the hinging action, the lock means comprising a displacable stop mounted in one segment which engages the other segment. At least one of the segments includes a laterally extending flange, the stop engaging one side of the flange to lock the segments relative to one another.

The ski boot also includes a foot-enveloping foot positioning device. The foot positioning device comprises a flexible body surrounding the arch and instep of a foot inside the ski boot when the boot is worn, and a pair of cables attached to upper and lower portions of the foot positioning device on opposite sides of the ski boot for adjusting the location of the foot positioning device within the boot. An adjustable tension control outside of the boot at the heel area of the boot is connected to the cables for drawing the cables and attached foot positioning device toward or away from the heel area. Preferably, the foot positioning device is adjustable in size with portions of the foot positioning device overlapping one another and having a hook-and-loop fastener to secure the overlapping portions.

BRIEF DESCRIPTION OF THE DRAWINGS

The invention is described in greater detail in the following description of examples embodying the best mode of the invention, taken in conjuction with the drawing figures, in which:

FIG. 4 is a top plan view of the ski binding portion of the invention, with the ski boot omitted;

FIG. 5 is a side elevational view thereof, shown in relation to the ski and ski boot, and including, in phantom, release positions for the incorporated ski brake and release arm;

FIG. 6 is a plan view of the release cam according to the invention;

FIG. 7 is a cross sectional view taken along lines 7—7 of FIG. 6;

DESCRIPTION OF EXAMPLES EMBODYING THE BEST MODE OF THE INVENTION

Figure 1:
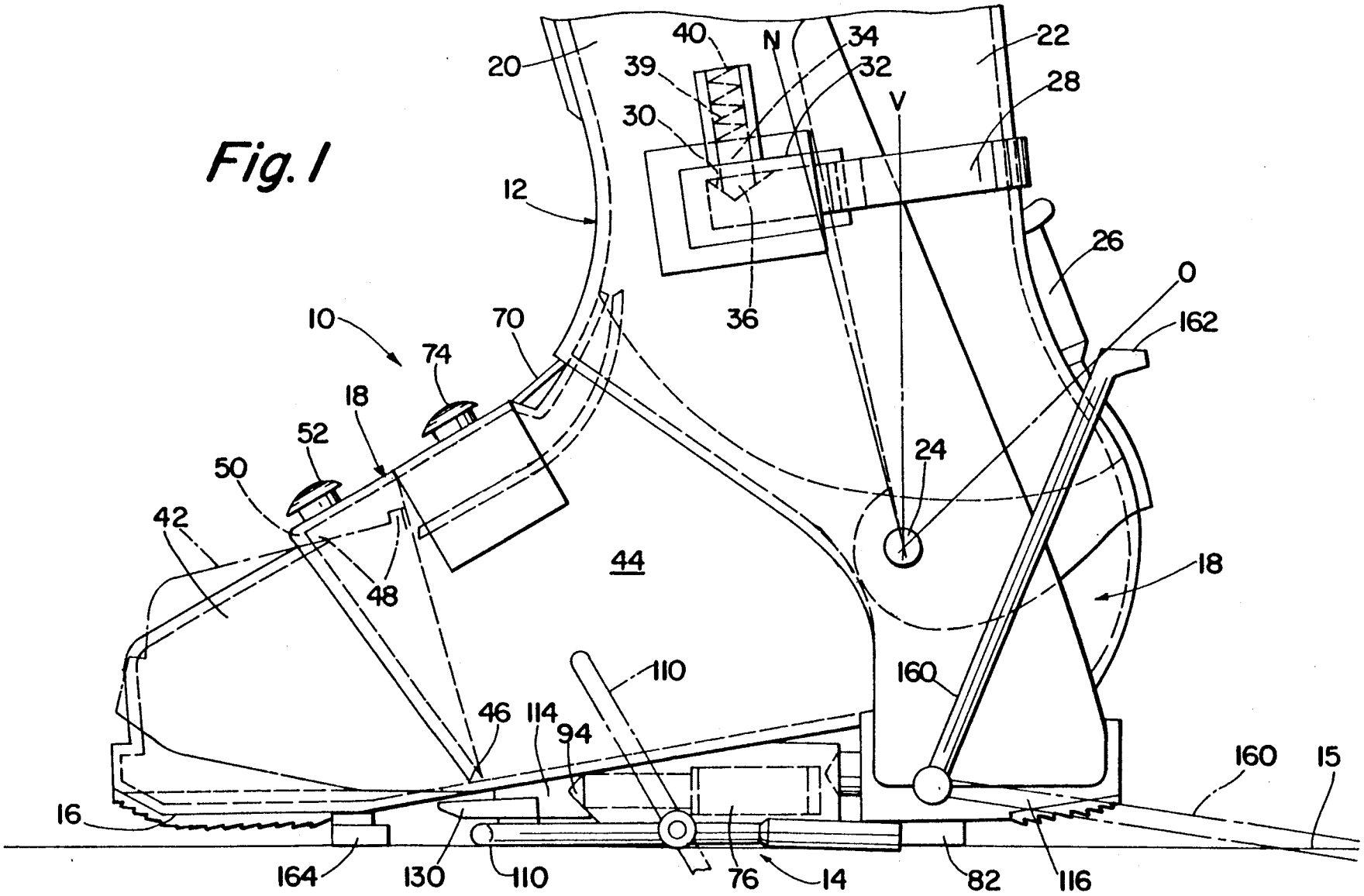
FIG. 1 is a side elevational view of one form of a combined ski boot and binding according to the invention.

A combined ski boot and binding according to the invention is shown generally at 10 in the drawing figures. It is comprised of a ski boot portion 12 and a binding portion 14 which is partially incorporated into the ski boot 12 and partially secured to a ski 15, as will become evident from the following description of the ski boot 12 and binding 14.

The ski boot 12 is of the clam shell type, having an integral sole 16 from which a foot shell 18 extends, and including a forward cuff 20 and a rear cuff 22 which pivot about a central pivot 24 located on opposite sides of the ski boot (only one side of the ski boot being illustrated in the drawing figures). The forward cuff 20 overlies the rear cuff 22, with the portion of the rear cuff 22 beneath the forward cuff 20 being shown in phantom in the drawing figures. The ski boot 12 may also include a conventional adjustment means 26 for adjusting the fit of the boot to the individual wearer's foot.

A strap 28 is used for securing the rear cuff 22 to the forward cuff 20. As is conventional, the strap 28 is secured to one side of the forward cuff 20 and extends about the rear cuff 22, being releasably engaged to the opposite side of the forward cuff 20. The type of attachment of the strap 28 to the one side of the forward cuff 20 has not been illustrated, and may be a buckle or other conventional means which will be quite evident to those skilled in the art. The opposite end of the strap 28 engages means for releasably securing the strap to the forward cuff 20 so that under predetermined rearwardly-directed load conditions, the strap 28 will separate from the forward cuff 20 to permit the rear cuff 22 to freely pivot rearwardly. To this end, the strap 28 includes a notch 30, and a strap channel 32 is secured to or formed in the inside of the forward cuff 20. An adjustable spring-loaded plunger 34 extends into the strap channel 32 and has a plunger nose 36 shaped to engage the notch 30.

Under normal load conditions, the rear cuff 22 bears against the strap 28, which in turn bears against the plunger 34 by means of the notch 30. The plunger 34 is normally held in place by means of a spring 38, the force of which may be adjusted by an adjustment screw 40. If the rearward force exerted by the cuff 22 against the strap 28 exceeds the holding force of the spring 38, the plunger 34 rises against the spring 38, allowing the strap 28 to become disengaged from the plunger 34 and therefore permitting the rear cuff 22 to open. The holding force of the spring 38, as adjusted by the adjustment screw 40, may be varied as desired to aid in preventing an anterior cruciate ligament tear in a skier's knee.

Figure 2:
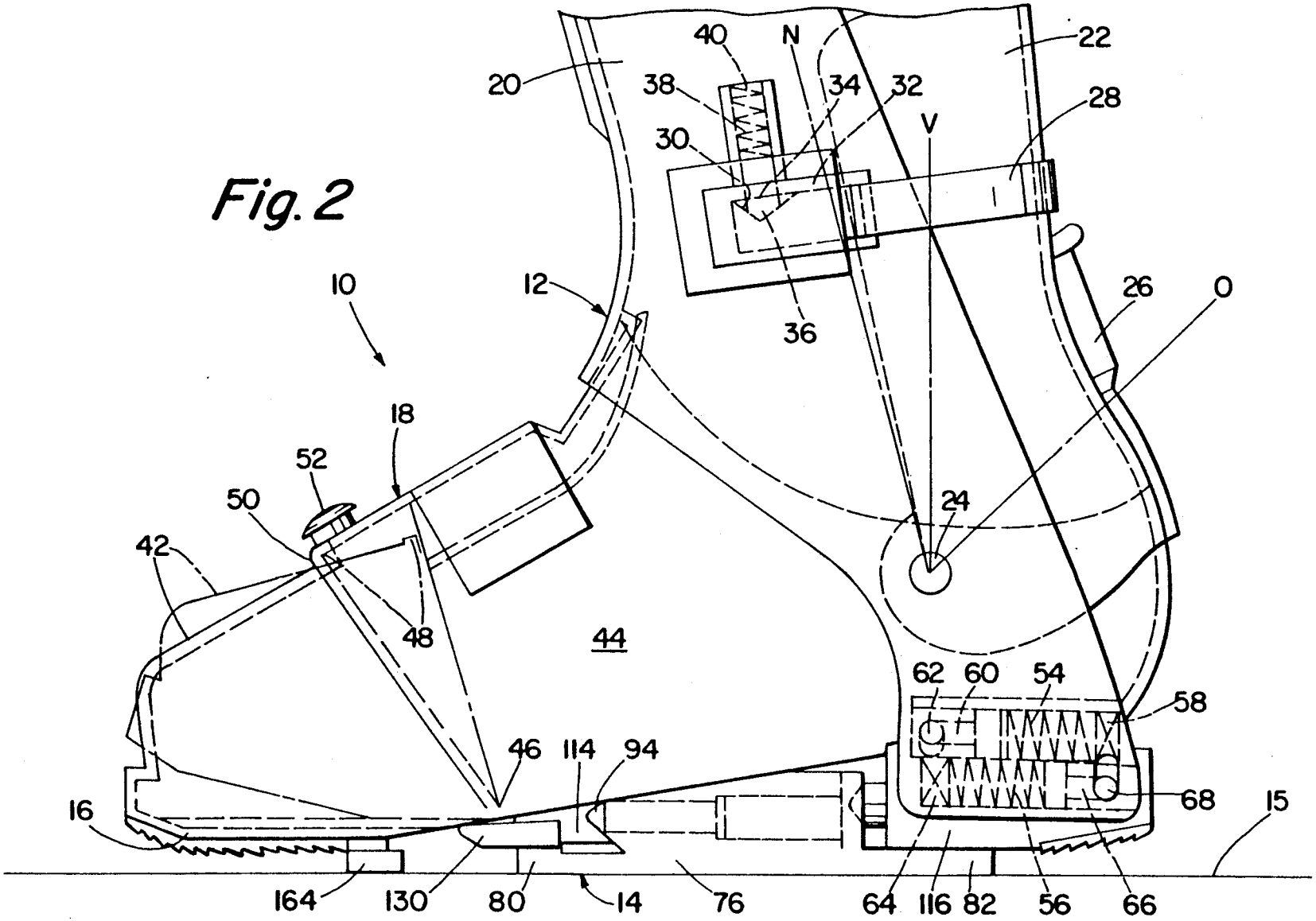
FIG. 2 is a side elevational view similar to FIG. 1, with portions omitted and with the springs for forward and rear lean control being illustrated.

The foot shell 18 is separated into first and second shell segments 42 and 44. As best shown in FIGS. 1 and 2, the second shell segment 44 overlaps the first shell segment 42, creating a living hinge 46 in the sole 16 at approximately the location of the ball of a foot when within the boot. The hinge 46 aids a skier tremendously while walking in a ski boot 12, since the typical ski boot has a rigid sole, thus having a fulcrum point at the toe when walking, rather than at the ball of the foot. The ski boot 12 of the present invention does not suffer that deficiency.

For proper functioning of the binding 14, the sole 16 must normally be rigid, and therefore the fulcruming of the hinge 46 must be eliminated. To this end, the first shell segment 42 includes an upstanding flange 48, and the second shell segment includes a downwardly depending, corresponding flange 50. The flanges interengage as shown so that the shell segment 42 may not be inadvertently withdrawn out of sliding engagement within the shell segment 44. In order to lock the first shell segment 42 relative to the second shell segmenet 44, a displaceable stop 52 is provided, engaging the flange 48. The stop 52 includes a spring (not illustrated) biasing the stop 52 in the position illustrated so that when the shell segments 42 and 44 are in the bold orientation shown in FIGS. 1 and 2 with the flange 48 sandwiched between the flange 50 and stop 52, the sole 16 is rigid, while if the stop is lifted to permit the flange 48 to pass therebeneath, the sole 16 is allowed to freely pivot about the living hinge 46, as shown in phantom in FIGS. 1 and 2.

Normally, in a clam shell-type ski boot arrangement, the front cuff 20 is rigidly fixed in place, and any forward movement of the cuff is due to either the flexibility of the material of the cuff, or the incorporation of a flexible insert into the cuff. To control both forward and rearward excursion of the cuff 20, incorporated into the ski boot 12 is a pair of springs 54 and 56 which are secured to the front cuff 20. The spring 54, which is adjustable by means of a screw adjustment 58, bears upon a plunger 60 which in turn bears upon a pin 62 secured to either the sole 16 or the foot shell 18. Similarly, the spring 56, which is adjusted by means of a screw adjustment 64, is secured to the forward cuff 20, and bears on a plunger 66 which in turn bears on a pin 68 secured to either the sole 16 or the foot shell 18. The spring 54 compresses upon forward lean against the forward cuff 20, and therefore controls the degree of forward lean, while the spring 56 compresses upon rearward lean of the cuff 20, and therefore controls the degree of rearward movement of the cuff 20 when the ski boot 12 is worn. Due to the separate screw adjustments 58 and 64, it should be evident that the forward and rearward lean can be adjusted independantly of one another.

Figure 3:
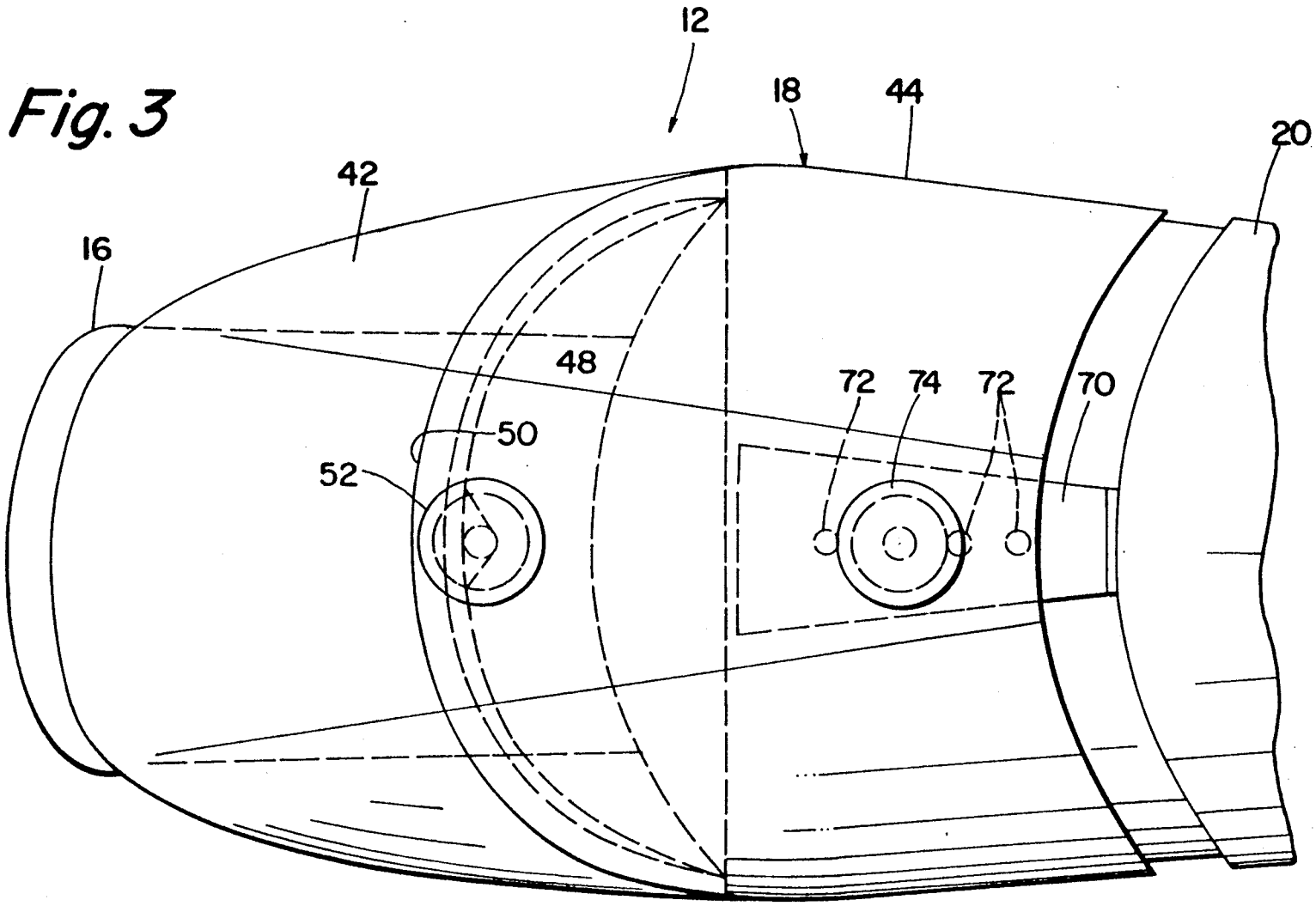
FIG. 3 is an enlarged partial top plan view of the invention, as illustrated in FIG. 1, with the ski omitted.

In a typical ski boot of the clam shell type, the forward cuff is normally locked at a particular angle, so that the skier, when wearing the boot, must stand at that predetermined angle. The ski boot 12 includes means for variably setting the forward lean of the cuff 20. As shown in FIG. 1, the ski boot 12 includes an attitude strap 70 secured to the forward cuff 20, and extending within the foot shell 18. The strap 70 includes a series of holes or detents 72 (FIG. 3), and a displaceable stop 74 is mounted in the shell segment 44 in registration with and engageable with each of the holes 72. The stop 74 is spring biased into the orientation illustrated, and must be lifted to be disengaged from an engaged hole 72.

The vertical is indicated in FIGS. 1 and 2 by V. The normal attitude of the forward cuff 20 is indicated by N, and may be altered depending on adjustment of the attitude strap 70. The open orientation of the rear cuff 22 is indicated by 0, approximately 45 degrees from the vertical V, thus allowing plenty of space for insertion of a skier's foot, and also opening quite adequately to help prevent anterior cruciate ligament tears.

The binding 14 includes two primary portions, a first connecting means secured to the ski 15 beneath the boot 12, and a second connecting means secured to the boot. Those portions are illustrated in detail in the first embodiment of FIGS. 1 through 19.

Figure 8:
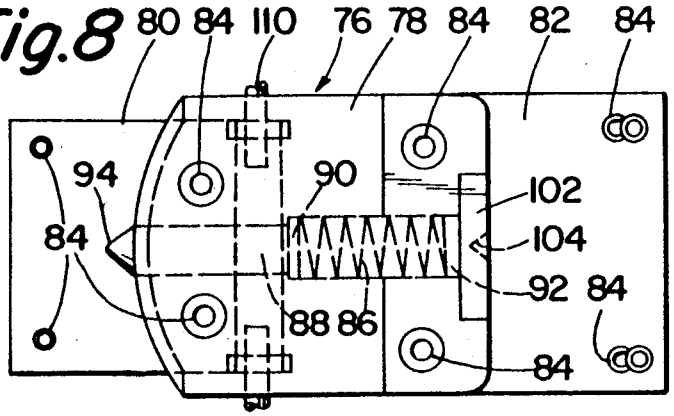
FIG. 8 is a top plan view of yet another form of the ski-mounted portion of the binding of the invention.
Figure 9:
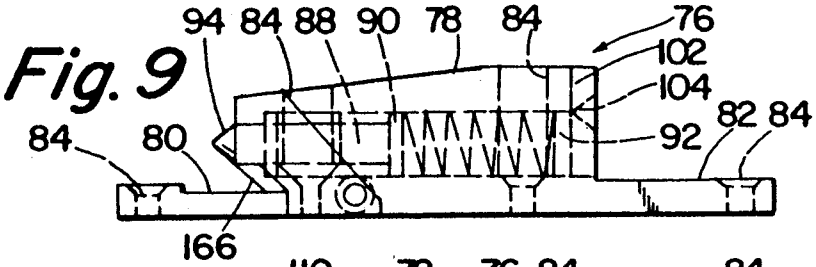
FIG. 9 is a side elevational view thereof.
Figure 10:
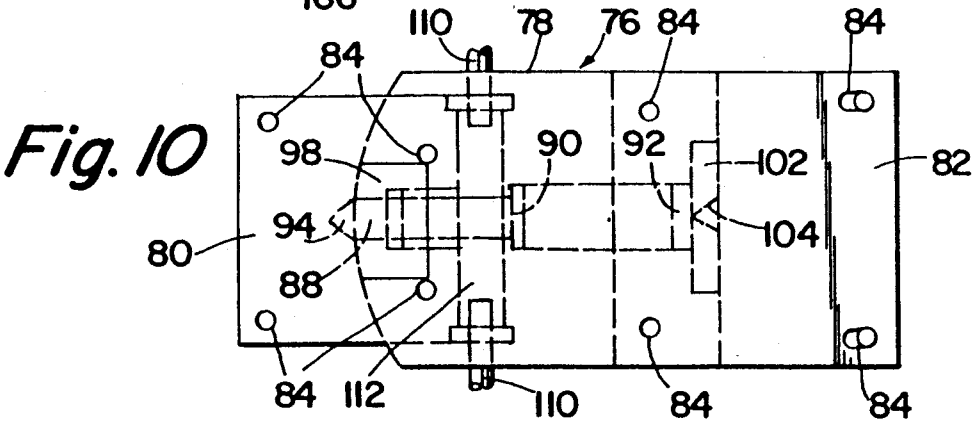
FIG. 10 is a bottom plan view thereof.

The first connecting means is designated generally at 76 in drawing figures, and is best shown in FIGS. 8 through 10. It comprises a central block 78 and extending forward and rear support portions 80 and 82 which are preferably integral extensions of the block 78. The block 78 and support portions 80 and 82 are provided with a series of mounting apertures 84 to permit the connecting means 76 to be securely attached to a ski. It is preferred that at least some of the apertures 84, such as those shown in the support portion 82, be elongated somewhat to accommodate flexing of the ski beneath the connecting means 76.

Figures 14A, 14B, 14C, 15, 16A, 16B, 16C, 17, 18A, 18B, 19:
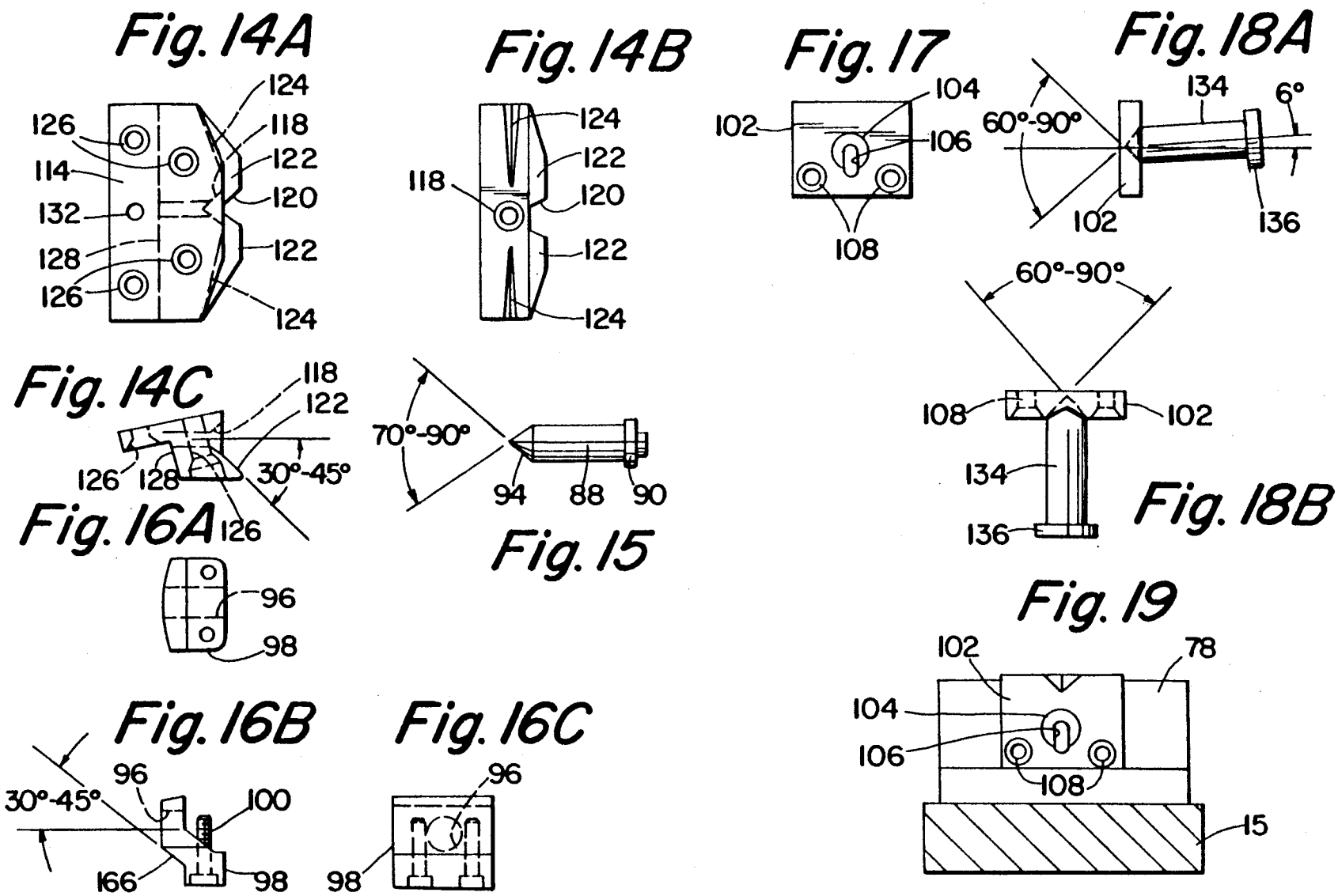
FIGS. 14A, 14B and 14C are, respectively, top, end and side views of the toe socket portion, or fore portion, of the ski binding of the invention.
FIG. 15 is a side elevational view of the front or minor plunger of the invention.
FIGS. 16A and 16B and 16C illustrate, respectively, top, side and elevational and rear views of a guide for the plunger for FIG. 11.
FIG. 17 is an elevational view of a socket for the rear, or major, plunger of the invention.
FIGS. 18A and 18B illustrate, respectively, side and top views of engagement of the rear plunger in its socket.
FIG. 19 is an elevational view, partly in cross section, showing the orientation of the socket for the rear plunger in relation to the ski.

The block 78 includes a stepped longitudinal central bore in which a spring 86 and plunger 88 are located. The spring 86 bears against an enlarged head or flange 90 on the plunger 88. An adjustment screw 92 is provided for alterning the force with which the spring 86 bears upon the enlarged flange 90. The plunger 88 has an extending nose 94 which, as will be seen below, engages a corresponding socket. The nose 94 extends through a bore 96 in a guide 98 which is preferably of metal and hardened to prevent any gouging or binding. The guide 98 is secured to the block 78 by means of a pair of screws 100 (FIG. 16). A socket plate 102 having a socket 104 and adjustment aperture 106 (for providing access to the adjustment screw 92) is mounted in the block 78 immediately adjacent to the adjustment screw 92. The socket plate 102 is best shown in FIGS. 17 through 19, and may be secured to the block 78 with screws passing through attachment apertures 108.

For halting a runaway ski, the first connecting means 76 also incorporates a conventional ski brake 110 having a spring 112 which biases the brake 110 against the block 78 to a substantially vertical orientation when the ski boot 12 is not attached to ski, that orientation being shown in phantom in FIGS. 1 and 5.

The second connecting means of the binding 14 comprises two parts secured to the ski boot 12. Those parts are a fore portion 114 and an aft portion 116. As best shown in the elevational drawing figures, the aft portion 116 takes the place of a heel of the ski boot 12, while the fore portion 114 is located beneath the arch.

The fore portion 114 preferably comprises a single metallic structure having a socket 118 shaped to be engaged by the nose 94 of the plunger 88. Also, for upward release of the binding 14 at the toe, the fore portion 114 includes a V-shaped gap 120 in a lower extension 122. For guiding the plunger 88 during release or reattachment of the elements of the binding 14, the fore portion 114 also includes a pair of guide grooves 124. For attachment of the fore portion 114 to the sole 16 of a ski boot 12, the fore portion 114 includes a series of holes 126.

The fore portion 114 is provided with a channel 128 which may carry an antifriction device 130 (FIGS. 1 and 2) secured thereto in a hole 132. The antifriction device 130 may be made of any friction-reducing plastic or other composition, as appropriate.

Figure 11:
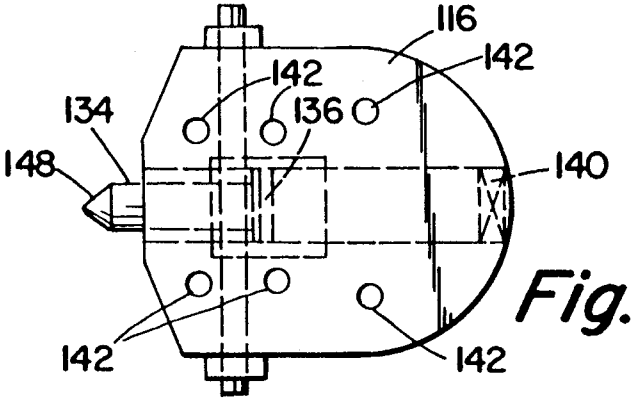
FIG. 11 is a top plan view of the heel portion for the ski boot which engages the ski-mounted portion of the first form of the invention shown in FIGS. 8 through 10.
Figure 12:
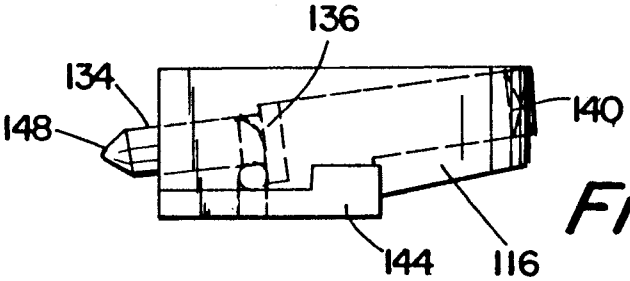
FIG. 12 is a side elevational view thereof.
Figure 13:
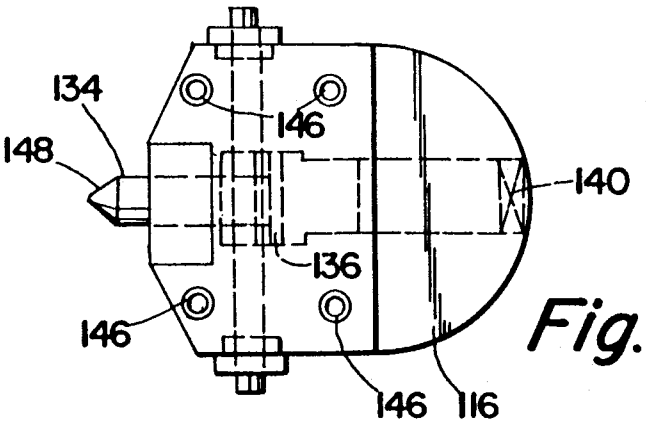
FIG. 13 is a bottom plan view thereof.

The aft portion 116 is best shown in FIGS. 11 through 13. It includes a stepped longitudinal central bore in which are mounted a plunger 134 having a flange 136 engaged by a spring 138 bearing against an adjustment screw 140. Adjustment of the screw 140 determines the compression force of the spring 138 against the flange 136. The aft portion 116 is also provided with a series of attachment aperatures 142 and a removable cover plate 144 which is secured to the aft portion 116 by appropriate fasteners in holes 146.

The plunger 134 includes a nose 148 angled to engage the socket 104. The plunger 134 is mounted to be temporarily withdrawn from the socket 104 to permit separation of the binding 14, and therefore removal of the ski boot 12 from attachment to the first connecting means 76 when secured to a ski 15. To this end, a rotatable lateral shaft 152 is secured within the aft portion 116 and includes a pair of integral cams 154 which are adjacent to, and bear upon, the flange 136. The cams 154 are spaced on opposite sides of the plunger 134. The shaft 152 includes a pair of integral collars 154 to allow proper alignment of the shaft 152, and includes threads 158 at either end. A cam actuation arm or lever 160 is appropriately secured to the threads 158 and extends about the heel of the ski boot 12 when the plunger 134 is in its normal orientation extending from the aft portion 116. The actuation arm 160 includes an enlarged actuation element 162 which may be engaged by the skier's hand or the tip of a skier's ski pole in order to rotate the actuation arm 160 to the released orientation shown in phantom in FIGS. 1 and 5. In that orientation, as best shown in FIG. 5, the plunger 134 is withdrawn the against the force of the spring 138 by the cams 154, and therefore the nose 148 of the plunger 134 is out of engagement with the socket 104.

The noses of the plungers 88 and 134 are angled to aid in adjusting holding force of the binding 14. The angles may range from 50 to 90 degrees, with the mated sockets having corresponding conical angles. Also, the lower extension 122 and mating portion of the block 76 are similarily angled to determine a range of holding force. Those angles may vary from 30 to 45 degrees from horizontal.

The binding 14 functions as follows. With the first connecting means 76 attached to a ski 50, and the fore and aft portions 114 and 116 secured to the ski boot 12, the actuation arm 160 is rotated to the downward position shown in phantom in FIGS. 1 and 5. Doing so causes the cams 154 to withdraw the plunger 134 into the aft portion 116, allowing the skier to step on the ski 15 over the first connection means 76. If desired, a toe guide (not illustrated) can be mounted on the ski 15 to aid in guiding the skier onto the ski 15. When the skier is in the proper orientation, the plunger 88 engages the socket 118, and in order to secure the skier in place on the ski 15, the actuation arm 160 is rotated to the normal orientation shown in the drawing figures, allowing the plunger 134 to engage the socket 104. The skier is then held firmly in place.

The plunge 134 is the major plunger, in that it controls forward and rear release of the binding 14, while the plunger 88 is the minor plunger, in that it provides for a lateral release of the binding 114, the rear plunger 134 serving as a fulcrum point for such lateral release. As explained above, the bearing force of each of the plungers 88 and 134 is adjustable by means of the respective adjustment screws 92 and 140, permitting different release settings to accommodate skiers of different weights and skiing abilities. Because of the different functions served by the plungers 88 and 134, the plungers need not be at equal elevations above the ski 150. Thus. to accommodate the major plunger 134 in the heel of the ski boot 12, the major plunger 134 is located at a greater elevation above the ski 15, and is angled downwardly slightly, as well. That downward angle may be on the order of six degrees.

For release in the forward direction, a fulcrum member 164 is mounted on the ski 150. The location of the fulcrum member 164 determines the lever arm between the fulcrum member 164 and the plunger 134, and therefore, given a particular setting of the spring 138, will dictate the amount of force necessary to separate the ski boot 12 from the ski 15 in the forward direction. Judicious placement of the fulcrum member 164 changes the length of the lever arm, and therefore the forward release characteristics. Similarly, the rear support portion 82 of the block 78 dictates the lever arm for the plunger 134 in the rear release direction. The support portion 82 serves as a fulcrum member for rearward release, and will dictate rearward release characteristics depending upon its extent beneath the boot 12. As explained above, the fore portion 114 includes a lower extension 122 which, as best shown in FIG. 5, extends within a corresponding groove 166 formed in the block 78 and the guide 98. On rearward release, the extension 122 captured beneath the groove 166 forces the ski boot 12 to move forwardly relative to the block 78, compressing the rear plunger 134 against the force of the spring 138. Full release occurs when the nose 94 of the plunger 88 passes through the gap 120.

It is preferred that the sockets 104 and 118 be separated from one another a distance of up to about 3 inches, therefore providing a very short lever arm for release in the lateral direction. Unlike conventional bindings, which are attached to the toe and heel of the boot, and therefore have a lever arm of typically 12 inches or more, misadjustment of the holding force with the three inch lever arm of the present invention will not tend to have such disasterous effects on the leg of a skier as does misadjustment with a lever arm of 12 inches or more.

Figure 20:
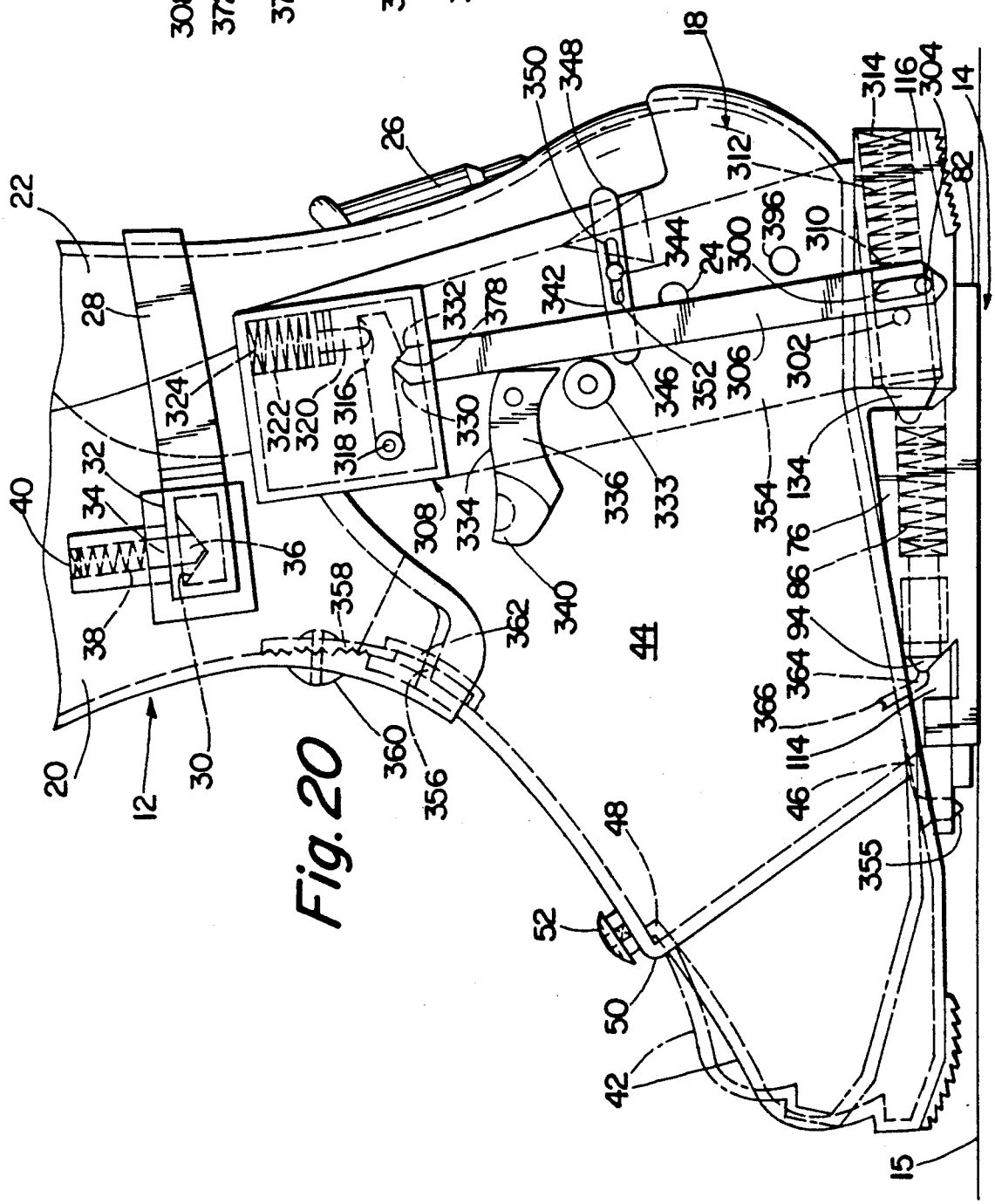
FIG. 20 is a side elevational view of another combined ski boot and binding according to the invention.

FIG. 20 illustrates an alternative form of the invention. Many illustrated parts are the same as depicted in the previous form of FIGS. 1–19, and therefore the same reference numerals are used throughout. Also, for the purposes of description in this and ensuing forms of the invention, certain items have been omitted for clarity of description, such as the ski brake 110, which would continue to be used in this form of the invention, as will be evident to one skilled in the art.

In this form of the invention, the plunger 134 is held in place in the socket 104 by means of a cam 300 bearing upon a pin 302 secured to the plunger 134. The cam 300 is secured to a shaft 304 which extends beneath the plunger 134 in a similar fashion to the shaft 152 (FIG. 6), the cam 300 appearing on opposite sides of the plunger 134. A lever arm 306 is also attached to the shaft 304, the lever arm 306 extending upwardly to an arm stay 308, described in greater detail below.

The cam 300 also bears on a flange 310 at one end of the plunger 134, the pin 302 and the flange 310 comprising stops on which the cam 300 alternately may bear, as will be described below. A spring 312 is captured between the flange 310 and an adjustment screw 314, the adjustment screw 314 being used to adjust the tension of the spring 312 as it bears against the flange 310.

The lever arm 306 engages a latch 316 of the arm stay 308. The latch 316 is pivotable about an axis 318 and is maintained in contact with the lever arm 306 by means of a spring-loaded plunger 320. A spring 322 bears on the plunger 320, its force being adjustable by means of an adjustment screw 324.

The lever arm 306 has a sloped retention surface 326 engaging a complementary sloped retention surface 328 of the latch 316. The lever arm 306 also has a sloped engaging surface 330, sloped at the same angle as a complementary sloped engaging surface 332 of the latch 316. The surfaces 330 and 332 are sloped oppositely from the surfaces 326 and 328, as shown. As explained below, the surfaces 330 and 332 are sloped at a lesser angle than the slope of the surfaces 326 and 328, since the steeper the slope, the greater the resistance to relative movement between the paired surfaces.

Because the lever arm 306 is pivotal, the extent of its forward motion is governed by a stop 333. For disengaging the lever arm 306 from the latch 316 (and thus disengaging the surfaces 326 and 328), a toggle 334 is secured to the shell segment 44 by means of a pivot 336. The toggle 334 has a cammed release surface 338 bearing against the lever arm 306 so that when the toggle 334 is rotated about the pivot 336, the release surface 338 forces the lever arm 306 to the right (FIG. 20) against the force of the restraining spring 322, disengaging the lever arm 306 from the latch 316. The toggle 334 is provided with an expanded actuator 340, which can be shaped to be hand-actuated, or which may be shaped to be engaged by the tip of a skier's ski pole.

If the pivot 336 is sufficiently strong, the stop 333 is redundant, and may be omitted, the toggle 334 then comprising a stop to limit the forward pivoting action of the lever arm 306. Without the stop 333, the toggle 334 is also self-adjusting when struck by the lever arm 306 when the arm 306 is closed (and the surfaces 326 and 328 are engaged).

As explained in the first form of the invention, upon rearward pivoting of the rear cuff 22, the binding 14 is automatically opened. A similar provision is included in the form of FIG. 20. An elongate, flat strap 342 is secured by means of a pin 344 to the shell segment 44. The strap 342 has a hook 346 engaging the lever arm 306, and a second hook 348 at its opposite end and oppositely directed to engage a raised cam 350 formed on the rear cuff 22. The strap 342 includes a slot 352 to permit the strap 342 to slide relative to the pin 344. Thus, as the rear cuff 22 is opened, the hook 348 engages the cam 350, which in turn slides the strap 342 to the right, causing the hook 346 to pivot the lever arm 306 to the right, disengaging the lever arm 306 from the latch 316.

To ensure that the shell segment 44 is sufficiently stiff between the arm stay 308 and the aft portion 116, a stiffener 354 may be used, located either inside the shell segment 44 as shown, or exterior thereto.

In the form of the invention shown in FIG. 20, forward and rear lean of the cuffs 20 and 22 is controlled by the forward cuff 20. To control the forward lean, the shell segment 44 is formed with an internal abutment 356. An engagement member 358, secured to the front cuff 20, is in alignment with the abutment 356. The engagement member 358 is secured to the cuff 20 by a fastener 360. The engaging surfaces of the cuff 20 and engagement member 358 may be roughened, toothed, or otherwise formed to ensure that the engagement member 358 remains in place when secured by the fastener 360.

To control rear lean, the abutment 356 forms a stop which engages a hooked strap 362 secured to the engagement member 358 which overlaps the abutment 356. The hook of the strap 362 engages the similarly-shaped abutment 356 to control the rearward lean. Any additional, excessive rearward force can be accomodated by the separating strap 28, as explained above.

While the build up of snow and ice is not normally a problem in the binding of the present invention, to ensure that snow or ice does not inhibit binding closure, a heat probe 364 may be employed in the fore portion 114. The heat probe 364 is immediately adjacent the socket engaged by the nose 94, and is connected by wires 366 to a suitable energy source (not illustrated), such as a battery pack worn by the skier or carried in the ski boot 12.

In operation, when the skier wishes to engage the ski boot 12 on the binding 14, the lever arm 306 is disengaged (pivoted to the right in FIG. 20). The skier, wearing the ski boot 12, then steps over the first connecting means 76, and steps downwardly. The downward motion retracts the plunger 134 against the spring 312, pivoting the arm 306, which is captured between the pin 302 and the flange 310 by means of the cam 300, farther to the right. When the boot 12 is in the position shown in FIG. 20, the plunger 134 is engaged with its socket, and the spring 312, bearing against the flange 310, pivots the lever arm 306 to the left. The relatively flatly-sloped engaging surfaces 330 and 332 engage, forcing the latch 316 against the plunger 320 to compress the spring 322. When the lever arm 306 strikes the toggle 334 (and/or stop 333), the relatively steeply-sloped retention surfaces 326 and 328 are engaged, retaining the lever arm 306 in place. By judicious adjustment of the force of the spring 322, and by judicious selection of the slopes of the surfaces 326 and 328, the holding force of the binding 14 for release in the forward direction (as explained above) is determined. For a forward fall, the plunger 134 is compressed, rotating the lever arm 306 until the force of the spring 322 is overcome to release the lever arm 306. The spring 312 is relatively weak, and contributes little to the retention of the lever arm 306.

Figure 21:
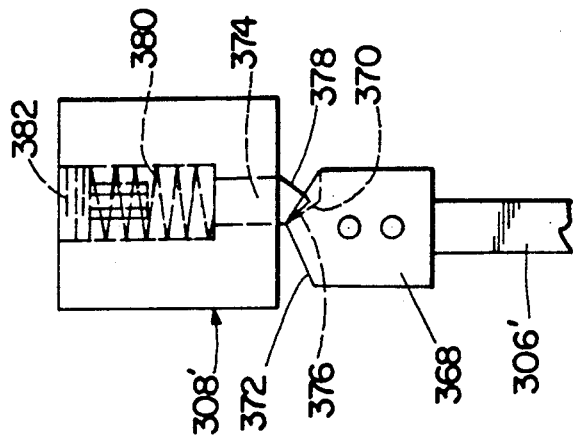
FIG. 21 is a side elevational view showing a modification of a portion of the combined ski boot and binding of FIG. 20.

An alternative form of the lever arm and arm stay is shown in FIG. 21. In this form of the invention, the lever arm 306' includes a top cap 368 having a sloped retention surface 370 formed in a groove of the cap 368. An oppositely directed engaging surface 372 is formed in the top of the cap 368. A plunger 374 of an arm stay 308' has formed in the nose thereof a similar retention surface 376 and engaging surface 378. The plunger 374 is held in place by means of a spring 380, adjustable by an adjustment screw 382. The engaging lever arm 306' and stay 308' of FIG. 21 function in the same manner as the engaging lever arm 306 and arm stay 308 of FIG. 20. The toggle 334 (not illustrated in FIG. 21), or a similar mechanism, would be used in combination with the lever arm 306' to disengage the lever arm 306' from the arm stay 308' when manual release of the boot 12 from the ski 15 is desired.

Figure 22:
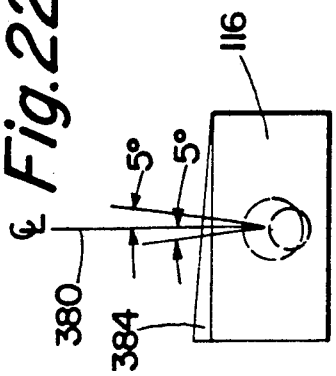
FIG. 22 is a schematic end view of the invention showing one form of canting.

FIG. 22 illustrates schematically one means that a cant may be used to cant the binding 14 relative to the ski boot 12 when the particular skier is bowlegged or knock-kneed, and requires canting. In FIG. 22, the aft portion 116 of the binding 14 has been illustrated, with the ski boot 12 thereabove being omitted for description purposes.

In order to cant the binding 14 relative to the ski boot 12, the aft portion 116 (and fore portion 114, although not illustrated) may include a cant 384 on the top thereof, situated between the aft portion 116 (and fore portion 114) and the ski boot 12. A center line 386 for the aft portion 116 is illustrated in FIG. 22, and by judicious selection of the thickness and placement of the cant 384, canting angles of 5° or more relative to the center line 386 may be introduced into the combination of the ski boot 12 and binding 14.

Figure 23:
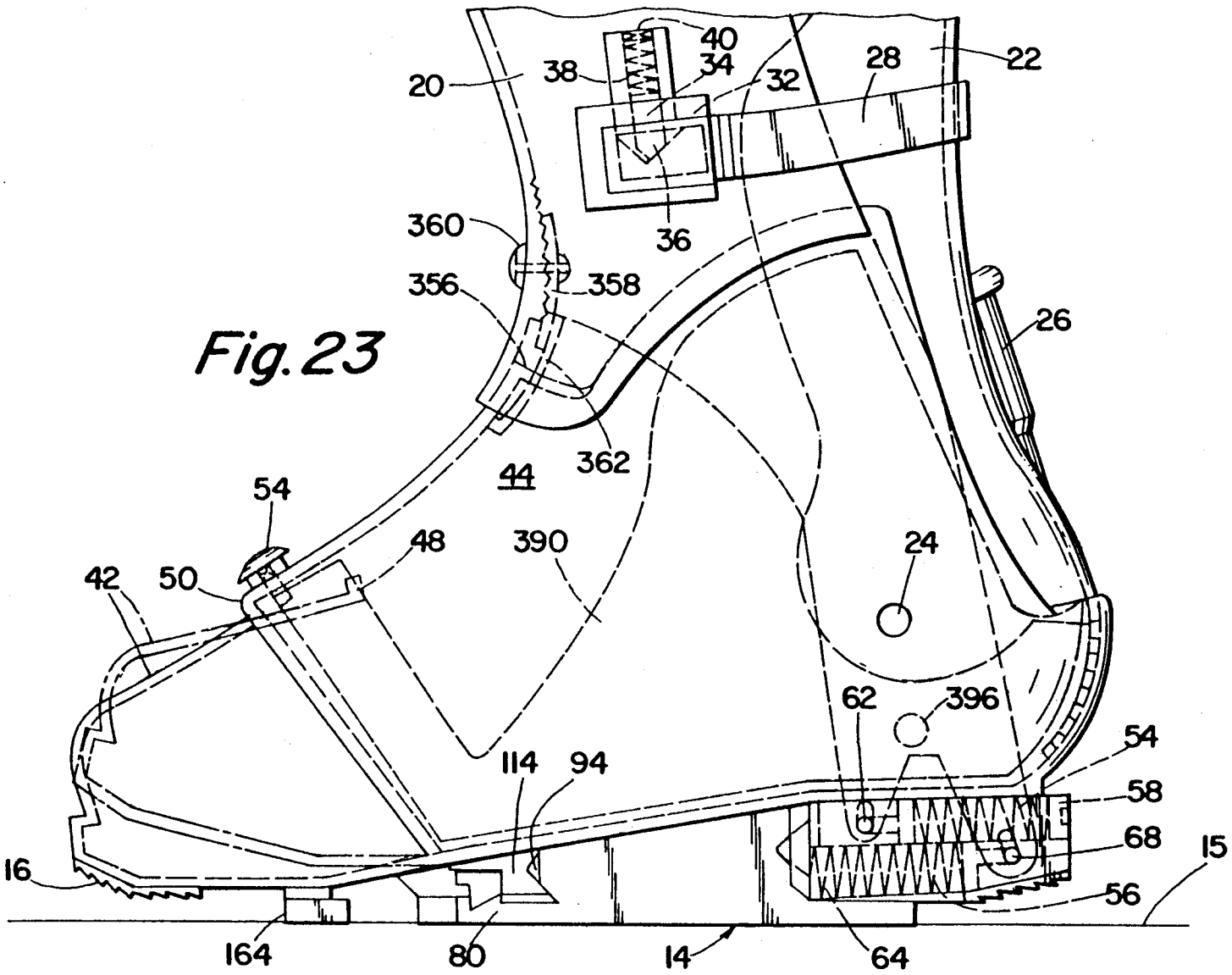
FIG. 23 is a side elevational view similar to FIG. 20, but with portions omitted for purposes of description, and showing a ski boot stiffener according to the invention.

FIG. 23 illustrates the ski boot 12 and binding 14 of FIG. 20, with portions removed for purposes of clarity, but otherwise being identical. In addition, FIG. 23 illustrates a stiffener 390 which, as illustrated, is inside the ski boot 12. The stiffener is located in the shell segment 44, extending between the sole 16 of the ski boot 12 and the location at which the stay 308 (FIG. 20) is attached to the ski boot 12. The stiffener 390 provides extra rigidity for the boot 12 to retain the stay 308 firmly in place. For added rigidity, the stiffener 390 may include a portion 392 extending over the ball of the foot. Also, although the stiffener 390 is illustrated as being located within the shell segment 44, the stiffener 390 may, just as easily, be located on the outside of the shell segment 44.

Figure 24:
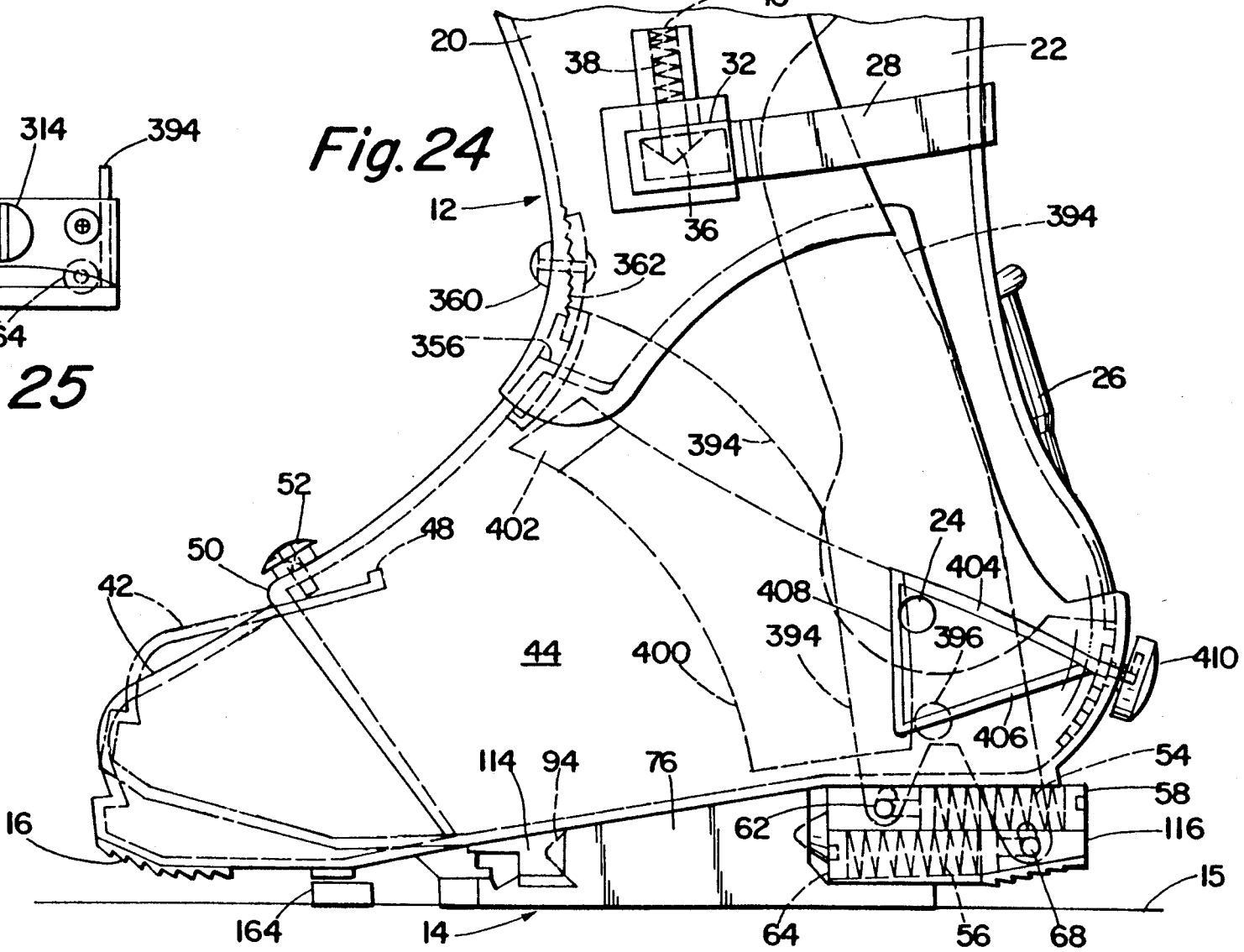
FIG. 24 is a side elevational view of a combined ski boot and binding similar to FIG. 20, and again with portions omitted for purposes of description, and showing a foot positioning device according to the invention.
Figure 25:
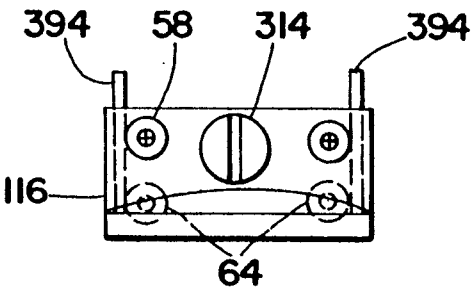
FIG. 25 is an end elevational view of the heel of a ski boot according to the invention showing locations for adjustment of some of the elements of the invention.

FIG. 24 illustrates the manner in which the forward cuff 20 is secured to the aft portion 116 and the springs 54 and 56 when using the lever arm arrangement of the invention (not illustrated in FIG. 24 for purposes of clarification). Otherwise, the ski boot 12 is the same as the ski boot 12 illustrated and described with respect to FIG. 20.

The forward cuff 20 includes an inner portion 394 that extends between the cuff 20 and the springs 54 and 56 on either side of the ski boot 12. In exactly the same manner that the forward cuff 20 of FIG. 1 is secured to the springs 54 and 56, the forward cuff 20 of FIG. 24 is connected to the springs 54 and 56 by means of the intervening inner portion 394. A pivot 396 in the shell 44 is secured to the inner portions 394, providing the pivot point on opposite sides of the foot for the forward cuff 20.

FIG. 24 also illustrates a foot positioning device 400. The foot positioning device 400 comprises a flexible, thin body, preferably of plastic, which surrounds the arch and instep of a foot inside the ski boot 12 when the boot is worn. The device 400 extends beneath the foot and on opposite sides of the foot, and includes a fastener 402 for fastening portions from opposite sides of the boot, and also for initial adjustment purposes. The fastener 402 may be an overlapping hook-and-loop fastener such as the well known "Velcro"-type fastener. For adjusting the foot positioning device 400, a pair of cables 404 and 406 are attached to upper and lower parts of the rear of the foot positioning device on opposite sides of the ski boot 12 (a single side shown in FIG. 24). A cable spacer 408, if necessary, may be used, secured to the foot positioning device 400 and conveniently forming a location to which the cables 404 and 406 are attached. The cables 404 and 406 extend to a rotatable tension control 410 outside of the ski boot 12 at the heel area. By judicious rotation of the tension control 410, the foot positioning device 400 (and hence the foot contained therewithin) can be moved fore or aft within the ski boot 12 to properly position the foot and hold the skier's heel down firmly within the ski boot 12. Alternatively, a lever or other appropriate tension control device may be employed in place of the rotatable tension control device 410.

Figures 26, 27A, 27B, 28:
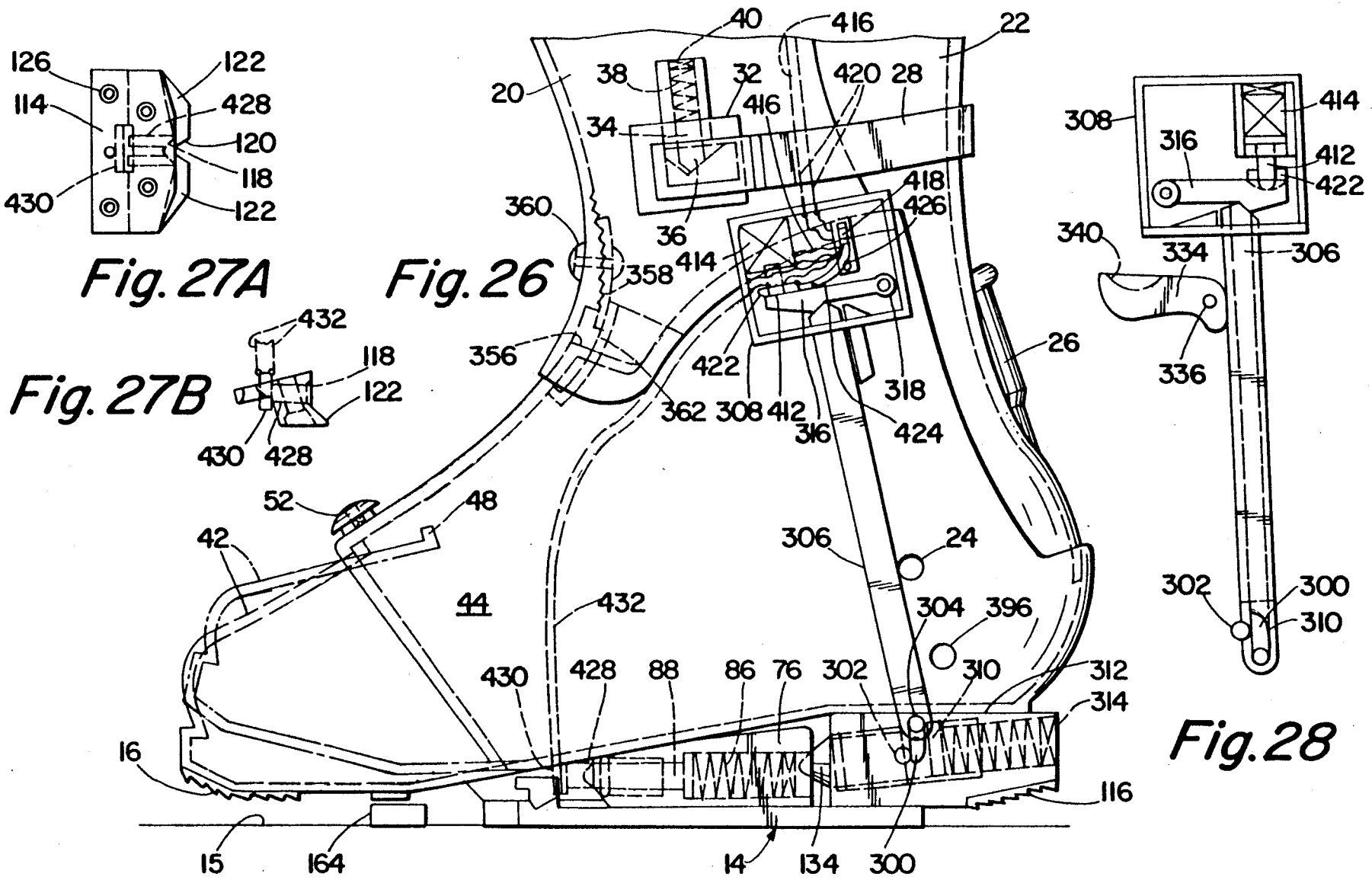
FIG. 26 is a side elevational view of yet another form of combined ski boot and binding according to the invention.
FIG. 27A is a top plan view of the front toe piece of FIG. 27.
FIG. 27B is a side elevational view of the toe piece of FIG. 27A.
FIG. 28 is an alternative form of the lever arm and associated mechanism of FIG. 26.

FIGS. 26–28 illustrate modified forms of the invention having electronic means for separating the ski boot 12 from the ski 15. Turning first to FIGS. 26 and 27, as in the form of the invention illustrated in FIG. 20, that illustrated in FIG. 26 includes a lever arm 306 secured to a shaft 304 and having a cam 300 located between a pin 302 and a flange 310 of the major plunger 134. In this form of the invention, releasing of the lever arm 306 is from right to left, as explained in a moment below, and therefore the shaft 304 is located above the major plunger 134, with the cams 300 extending downwardly from the lever arm 306. Functioning of the lever arm 306 is identical to the form of FIG. 20.

As in the form of the invention illustrated in FIG. 20, an arm stay 308 is secured to the shell segment 44 above the lever arm 306, and includes a latch 316 pivotally secured within the stay 308 at an axis 318. The latch 316 is held in place by means of a solenoid activated plunger 412 bearing on the latch 316, and including a solenoid 414. The solenoid 414 is connected by wires 416 to a microprocessor 426. Power is provided by a switch 418, which is connected to the microprocessor 426, and then by wires 420 to a power source (not illustrated), such as a battery pack worn by the skier about the waist. For sensing the necessity for release, the arm stay 308 of FIG. 26 also includes a force transducer 422 connected by wires 424 to the microprocessor 426. The transducer 422 senses force exerted by the latch 316 (due to force being applied by the lever arm 306), and transmits the sensed force to the microprocessor 426. The microprocessor 426 is programmed in a conventional manner to activate the solenoid 414 via the wires 416 when a predetermined force has been sensed by the transducer 422. Activation of the solenoid 414 permits the latch 316 to freely raise, releasing the lever arm 306, and thus permitting the ski boot 12 to separate from the ski 15.

As explained above, the major plunger 134 allows release in the forward and rearward directions, and thus the force transducer 422 functions to sense release conditions in those directions. In order to sense the need for a lateral release, the minor plunger 88, engaged in its socket 118, bears upon a stationary and complementary plunger 428 located in the fore portion 114. The plunger 428, in turn, terminates at a second force transducer 430 connected by wires 432 to the microprocessor 426. Force exerted by the plunger 88 against the plunger 428 is sensed by the force transducer 430, and transmitted via the wires 432 to the microprocessor 426. When a release condition is experienced, the microprocessor 426 activates the solenoid 414 to release the lever 316, releasing the lever arm 306 and thus permitting the ski boot 12 to separate from the ski 15.

FIG. 28 illustrates the same solenoid activated release mechanism as illustrated in FIG. 26, except that the lever arm opens in the opposite direction, left-to-right in FIG. 28 as opposed to right-to-left in FIG. 26. The version illustrated in FIG. 28 is therefore an exact electronic equivalent to the form of the invention illustrated in FIG. 20. In either of the forms of the invention shown in FIGS. 26 and 28, the toggle 334 can be employed for manual release of the lever arm 306 (after the switch 418 has been turned off, deactivating the solenoid 414). The toggle 334 is illustrated in FIG. 28, and a mirror image thereof, bearing on the right of the lever arm 306 of FIG. 26, would be employed in FIG. 26.

It will be evident from the foregoing description of various examples embodying the invention that the invention may take other physical forms, as well. Various changes may be made to the invention without departing from the spirit thereof or scope of the following claims.

What is claimed is:

1. In combination, a ski boot and a binding for releasably attaching the ski boot to a ski, comprising a. first connecting means secured to the ski beneath the ski boot, b. second connecting means secured to the ski boot and spanning said first connecting means with portions of said second connecting means being in a fore-and-aft relationship generally along the length of the ski, c. means for releasably coupling said first and second connecting means so that said first and second connecting means may be separated in the forward, backward, or lateral directions, or a combination thereof, under predetermined load conditions, said coupling means including a first coupling element of said first connecting means engaged by a second coupling element of said second connecting means, and d. actuation means for both urging said first and second coupling elements into engagement and temporarily disengaging said first and second coupling elements, said actuation means including i. a pivotal lever arm having opposite ends and being secured at one end to one of said first and second coupling elements, and ii. an arm stay secured to the ski boot at the other end of said lever arm, said stay including means for retaining said lever arm and for releasing said lever arm to permit said lever arm to pivot away from said retaining means about said one end.

2. The combination according to claim 1 in which said coupling means includes a. a major plunger means and a minor plunger means aligned with one another in the same direction and generally parallel to the longitudinal axis of the ski, said minor plunger means being located in said first connecting means and said major plunger means being located in said second connecting means and comprising said second coupling element, and b. first and second spaced and aligned socket means, each being engaged by one of said plunger means, one of said socket means being located in said first connecting means and comprising said first coupling element, the other of said socket means being located in said second connecting means.

3. A combination according to claim 2 in which said major plunger means is located in the aft portion of said second connecting means.

4. A combination according to claim 2 in which said major plunger means is mounted to control separation in the forward and backward directions, and said minor plunger means is mounted to control separation in the lateral direction.

5. A combination according to claim 1 in which said second coupling element comprises a plunger in the aft portion of said second connecting means and said first coupling element comprises a socket, and in which said actuator means includes spaced first and second stops on said plunger, a rotatable cam secured to a shaft, and said one end of said lever arm being secured to said shaft, with said cam being mounted between and bearing upon said stops.

6. A combination according to claim 5 in which said stops are mounted in fore-and-aft relationship, said cam bearing on said fore stop to urge said plunger into engagement with said socket, and said cam bearing on said aft stop to temporarily disengage said plunger from said socket.

7. A combination according to claim 5 including means for automatically engaging said lever arm with said arm stay to engage said plunger with said socket.

8. A combination according to claim 7 including a spring in axial alignment with and bearing upon said plunger to urge said plunger in the fore direction, said spring comprising said means for automatically engaging.

9. A combination according to claim 1 in which said ski boot includes a foot shell and a sole integral with said foot shell, said arm stay being secured to said foot shell.

10. A combination according to claim 9 including means stiffening said shell between said sole and said stay to maintain said shell rigid.

11. A combination according to claim 1 in which said ski boot includes hinged forward and rear cuffs which, when fastened to the leg of a skier, permit forward and rearward leg lean by the skier, and including means for controlling the forward and rearward lean.

12. A combination according to claim 11 in which said means for controlling comprises oppositely directed springs connected between said forward cuff and an immobile portion of said boot.

13. A combination according to claim 11 in which said ski boot includes a foot shell, and in which said means for controlling forward lean comprises an abutment in said foot shell and an aligned engagement member in said forward cuff, said engagement member being spaced from said abutment.

14. A combination according to claim 13 including means for adjusting the position of said engagement member relative to said abutment.

15. A combination according to claim 11 in which said ski boot includes a foot shell, and in which said means for controlling rearward lean comprises a stop in said foot shell and an associated strap in said forward cuff and overlapping said stop, said strap including means engaging said stop.

16. A combination according to claim 15 including means for adjusting the position of said means engaging said stop relative to said stop.

17. A combination according to claim 1 in which said ski boot includes hinged forward and rear cuffs, said rear cuff being positionable between open and closed orientations, and including release means secured to said rear cuff and engaging said lever arm for automatically disengaging said coupling elements when said rear cuff opens to said open orientation.

18. A combination according to claim 17 in which said release means comprises an elongate, flat strap having one end engaging said rear cuff and having a hook at the opposite end engaging said lever arm.

19. A combination according to claim 1 including disengagement means adjacent said lever arm for pivoting said lever arm to disengage said coupling elements.

20. A combination according to claim 19 in which said disengagement means comprises a toggle member pivotal about a fixed point and having a cammed release surface engaging said lever arm.

21. A combination according to claim 1 including means in said second connecting means for heating a portion of said second connecting means to melt entrapped snow and ice.

22. A combination according to claim 21 in which said second coupling means includes a socket for engagement by a plunger in said first connecting means, and in which said heating means comprises a heat probe connected to said socket.

23. A combination according to claim 1 in which said actuation means includes a pivotal latch having a sloped first retention surface and said lever arm includes a complementary sloped second retention surface at said other end engaging said first retention surface, and further including means holding said latch.

24. A combination according to claim 23 in which said latch further includes a sloped first engaging surface and said lever arm includes a complementary sloped second engaging surface, said engaging surfaces being sloped oppositely from said retention surfaces.

25. A combination according to claim 24 in which the slopes of said engaging surfaces are less than the slopes of said retention surfaces.

26. A combination according to claim 23 in which said holding means comprises a spring loaded plunger engaging said latch.

27. A combination according to claim 23 in which said holding means comprises a solenoid activated plunger engaging said latch.

28. A combination according to claim 27 including means for actuating said solenoid activated plunger.

29. A combination according to claim 28 in which said actuating means includes a force transducer located on said latch and a microprocessor, said transducer being connected to said microprocessor and said microprocessor being connected to said solenoid activated plunger to activate said plunger dependent upon signals received from said transducer.

30. A combination according to claim 28 in which said coupling means includes a third coupling element of said first coupling means engaging a fourth coupling element of said second coupling means.

31. A combination according to claim 30 in which said actuating means includes a force transducer in contact with said fourth coupling element and a microprocessor, said transducer being connected to said microprocessor and said microprocessor being connected to said solenoid activated plunger to activate said plunger dependent upon signals received from said transducer.

32. A combination according to claim 30 in which said actuating means includes a first force transducer located on said latch, a second force transducer in contact with said fourth coupling element, and a microprocessor, said transducers being connected to said microprocessor and said microprocessor being connected to said solenoid activated plunger to activate said plunger dependent upon signals received from either of said transducers.

33. A combination according to claim 2 including means for canting said ski boot relative to the ski.

34. A combination according to claim 33 in which said ski boot includes a foot shell and an integral sole to which said second connecting means is secured, and in which said means for canting comprises an angled cant between said sole and said second connecting means.

* * * * *